US009568278B1

(12) United States Patent
Jordan

(10) Patent No.: US 9,568,278 B1
(45) Date of Patent: Feb. 14, 2017

(54) RANGEFINDING BOWSIGHT SYSTEM

(71) Applicant: Brian Jordan, Longview, TX (US)

(72) Inventor: Brian Jordan, Longview, TX (US)

( * ) Notice: Subject to any disclaimer, the term of this patent is extended or adjusted under 35 U.S.C. 154(b) by 0 days.

(21) Appl. No.: 15/081,338

(22) Filed: Mar. 25, 2016

Related U.S. Application Data

(60) Provisional application No. 62/139,084, filed on Mar. 27, 2015.

(51) Int. Cl.
*F41G 1/467* (2006.01)
*F41B 5/14* (2006.01)
*F41G 3/06* (2006.01)
*F41G 3/14* (2006.01)

(52) U.S. Cl.
CPC ..... *F41G 1/467* (2013.01); *F41B 5/1492* (2013.01); *F41G 3/06* (2013.01); *F41G 3/14* (2013.01)

(58) Field of Classification Search
CPC ..... F41G 1/467; F41G 3/06; F41B 5/1492
USPC ..... 124/86, 87, 88, 90; 33/265
See application file for complete search history.

(56) References Cited

U.S. PATENT DOCUMENTS 4,617,741 A * 10/1986 Bordeaux ..... F41G 1/473 124/87
4,643,159 A * 2/1987 Ryan ..... G03B 29/00 124/24.1
4,894,921 A * 1/1990 Barlow ..... F41G 1/467 33/265
5,479,712 A * 1/1996 Hargrove ..... F41G 1/473 124/88
5,575,072 A * 11/1996 Eldridge ..... F41G 1/467 124/87
5,611,324 A * 3/1997 Kursinsky ..... F41B 5/1492 124/86
5,634,278 A * 6/1997 London ..... F41G 1/467 124/87
5,914,775 A * 6/1999 Hargrove ..... F41G 1/467 124/87
6,073,352 A * 6/2000 Zykan ..... F41G 1/467 33/265
6,286,796 B1 * 9/2001 Pugliesi ..... F41B 5/1492 124/88
6,526,956 B1 * 3/2003 Hankins ..... F41B 5/1492 124/86
6,556,245 B1 * 4/2003 Holmberg ..... A01M 31/00 348/207.99
6,952,881 B2 * 10/2005 McGivern ..... F41G 1/467 124/87
7,162,806 B1 * 1/2007 Swiggart ..... F41G 1/467 124/87
7,614,156 B1 * 11/2009 Imig ..... F41G 1/467 124/87
7,743,518 B2 * 6/2010 Khoshnood ..... F41G 1/467 124/87
8,065,807 B2 * 11/2011 Rucinski ..... F41G 1/467 124/87

(Continued)

*Primary Examiner* — Alexander Niconovich
(74) *Attorney, Agent, or Firm* — Richard G. Eldredge

(57) ABSTRACT

A combination of a bow and a range finder system. The bow having a body with a draw string. The range finder system having a frame with a mounting bracket secured to one end, the mounting bracket being configured to engage with the body of the bow; a housing secured to the frame; a camera carried by the housing; and a display secured to the frame conductively coupled to the camera.

5 Claims, 6 Drawing Sheets

(56) References Cited

U.S. PATENT DOCUMENTS

| | | | | |
|---|---|---|---|---|
| 8,166,962 | B2 * | 5/2012 | Volpe | F41G 3/06 124/87 |
| 8,286,871 | B2 * | 10/2012 | Bay | F41G 1/35 235/404 |
| 8,316,551 | B2 * | 11/2012 | Gorsuch | F41G 1/467 124/87 |
| 8,596,257 | B2 * | 12/2013 | Volpe | F41G 1/467 124/87 |
| 8,826,551 | B2 * | 9/2014 | Gibson | F41G 1/467 124/87 |
| 9,004,056 | B2 * | 4/2015 | Volpe | F41G 1/467 124/87 |
| 2005/0246910 | A1 * | 11/2005 | Mowers | F41G 1/467 33/266 |
| 2015/0040409 | A1 * | 2/2015 | Morrison | F41B 5/1492 33/228 |
| 2016/0069643 | A1 * | 3/2016 | Lyren | F41G 1/35 345/589 |
| 2016/0178319 | A1 * | 6/2016 | Grace, Jr. | F41G 1/467 42/71.01 |

* cited by examiner

105

RANGEFINDING BOWSIGHT SYSTEM

BACKGROUND

1. Field of the Invention

The present invention relates generally to compound bow sights, and more specifically, to an integrated camera, display monitor, rangefinder, and bow sight; referred to as a rangefinding bow sight system.

2. Description of Related Art

Bow sights are well known in the art and are an effective means of aiming the arrow prior to making a shot. In FIGS. 1 and 2, a commonly known bow system 101 is shown. The bow system 101 includes a cable 107 which attaches to a bow frame 103 through cams 105. The cams 105 are pivotably attached to the frame 105. Therefore, a torsion force is created when the cable 107 is pulled away from the frame 105 which in turn, is used to propel the arrow.

As shown in FIG. 2, the bow sights are open, requiring the user have great eyesight and judgment in order to direct the arrow toward the target. This is a common problem associated with conventional bow sights. Additionally, the user is responsible for predicting the distance to the target and attempting to self correct the aiming of the arrow in order to compensate for the drop in arrow height. This process requires great skill and practice which can be undesirable for novice and professional bow hunters alike.

Although great strides have been made in the area of bow sights, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
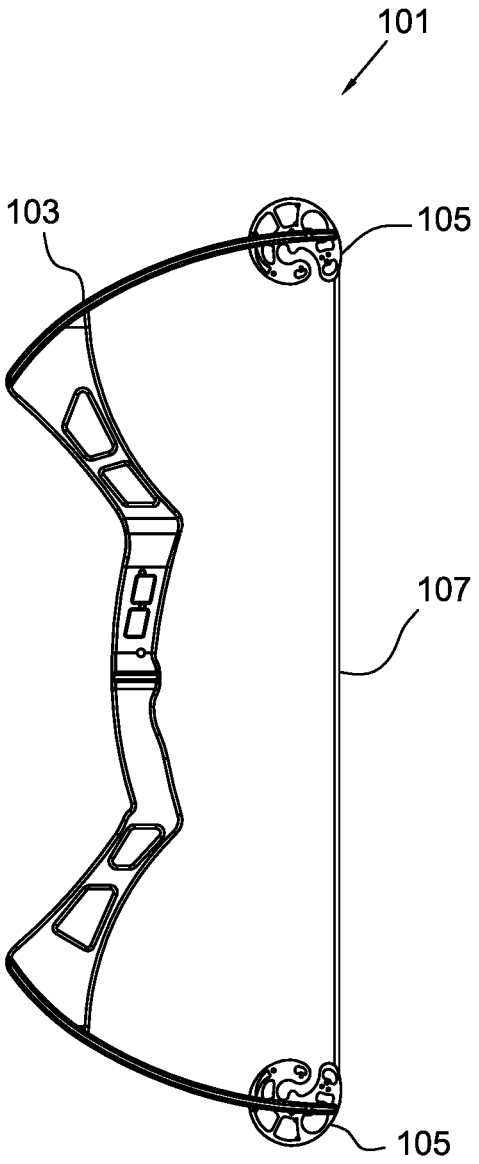
FIG. 1 (PRIOR ART)
FIG. 1 is a side view of a conventional bow sight system.
Figure 2:
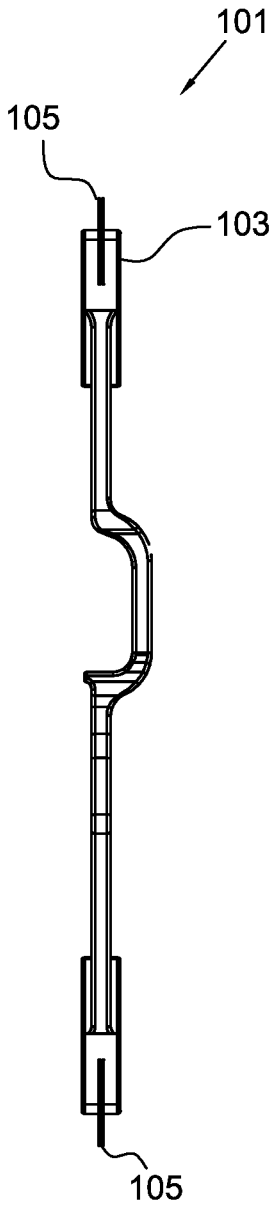
FIG. 2 (PRIOR ART)
FIG. 2 is a front view of a conventional bow sight system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional bow sight systems. Specifically, the system of the present application provides the user with the distance to the target through the use of a rangefinder. Additionally, the system of the present application contains a lighted sight pin which illuminates to notify the user when the target is within range based on the rangefinder distance. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 3:
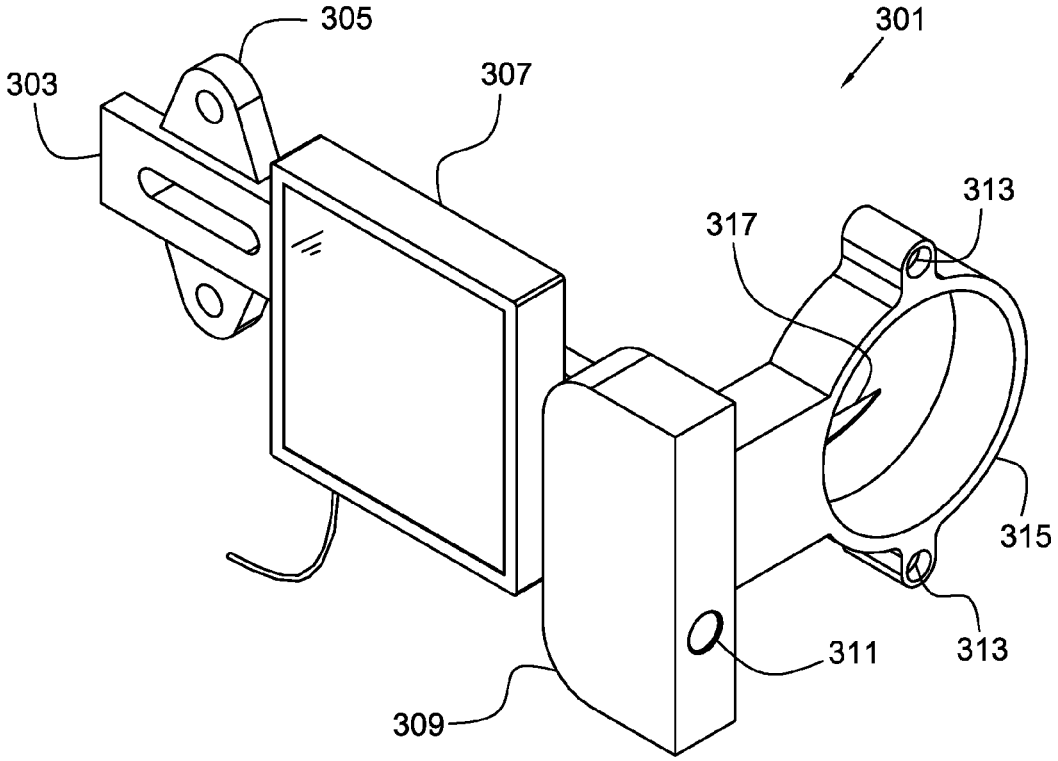
FIG. 3 is an oblique view in accordance with a preferred embodiment of the present application.
Figure 4:
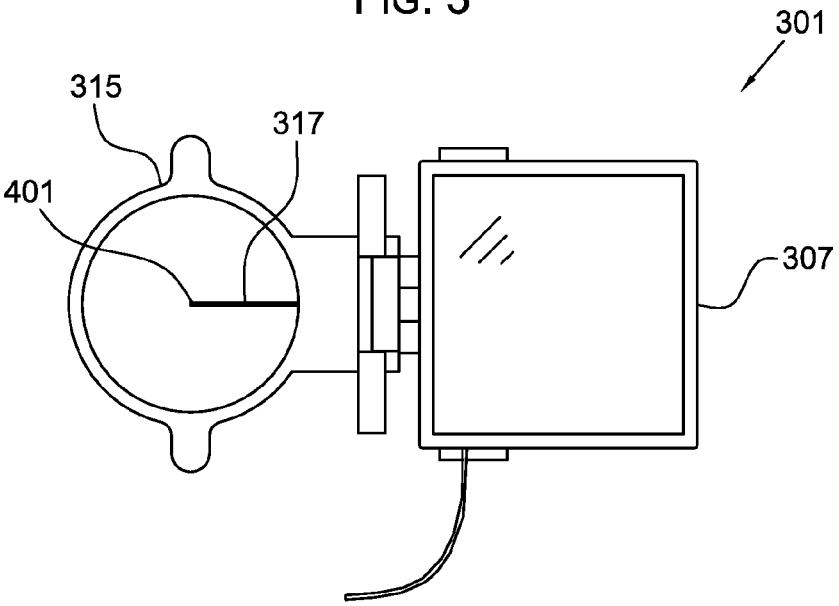
FIG. 4 is a front view of the rangefinding bow sight system of FIG. 3.

Referring now to the drawings wherein like reference characters identify corresponding or similar elements throughout the several views, FIGS. 3 and 4 depict a rangefinding bow sight system 301 in accordance with a preferred embodiment of the present application. It will be appreciated that the rangefinding bow sight system 301 overcomes one of more of the above-listed problems commonly associated with the conventional bow sights.

In a preferred embodiment, system 301 includes a display monitor 307, camera 311 housed in enclosure 309, and bow sight aperture 315 which are mechanically connected through a frame 303. A bow mounting bracket 305 is adjustably attached to the frame 303 as depicted in FIG. 3. The display monitor 307 is pivotably attached to the frame as will be discussed in further detail later. The enclosure 309 with internal camera 311 is removably attached to the frame 303 as well as the sight aperture 315.

The display monitor 307 is used to provide the user with a means of recording live pictures and videos captured by the camera 311. It is contemplated that the display monitor 307 is a touchscreen device which will provide a means for the user to interact with the system. Therefore, the display monitor 307 will also allow for all of the programming and calibration functions of the system.

The enclosure 309 supplies a protective housing for the camera 311 as well as the additional electrical and mechanical components. The sight aperture 315 aids the user in pin-pointing the shot using a single pin 317 which is centered in the sight aperture 315. The sight aperture 315 includes range finder lasers 313 with angle compensation capabilities.

System 301 measures the distance to a moving target upon activation and displays the distance on the display monitor. The range finder lasers 313 which are calibrated to the center of the sight aperture 315 measure the distance to the target, then send the information to a circuit board which will translate the information to the mechanical components, then automatically adjust the sight aperture 315 to the correct position. Thus, the contemplated embodiment overcomes the problems associated with conventional bow sights.

As depicted in FIG. 4, system 301 preferably includes a sight pin 317 with an embedded fiber optic cable 401. One or more concealed micro LED lights are projected through the fiber optic cable 401 to notify the user when it is safe to execute the shot.

Figure 5A:
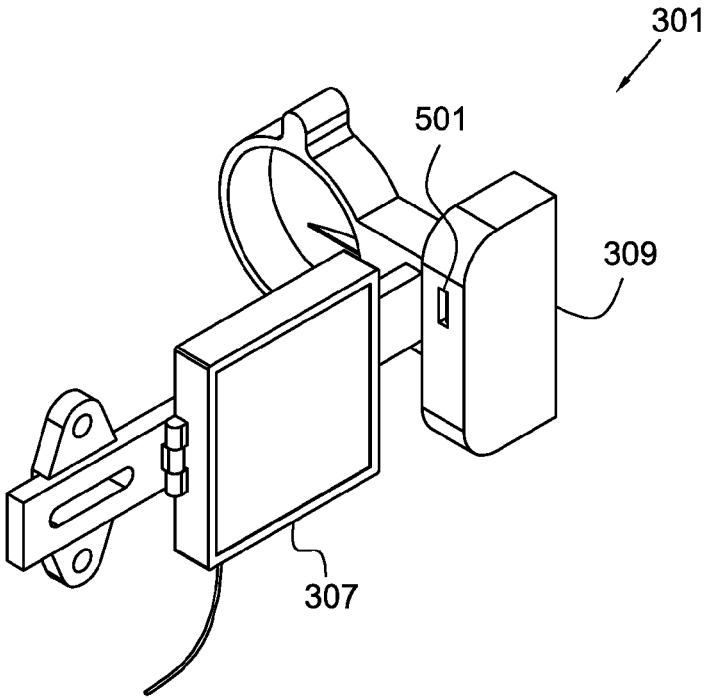
FIGS. 5A & 5B are oblique views of the rangefinding bow sight system of FIG. 3.
Figure 5B:
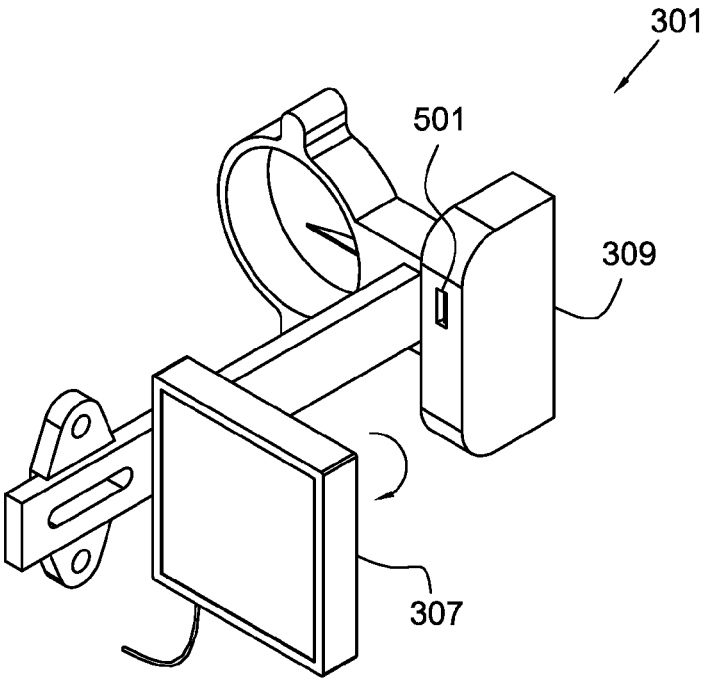

Referring now to FIGS. 5A & 5B, oblique views of system 301 are shown in accordance with a preferred embodiment of the present application. In FIG. 5A, the back of enclosure 309 is shown with battery charging port 501. Also, the display monitor 307 is shown in the stowed position to give a detailed view of the pivoting attachment. FIG. 5B depicts display monitor 307 in the deployed position.

Figures 6A, 6B:
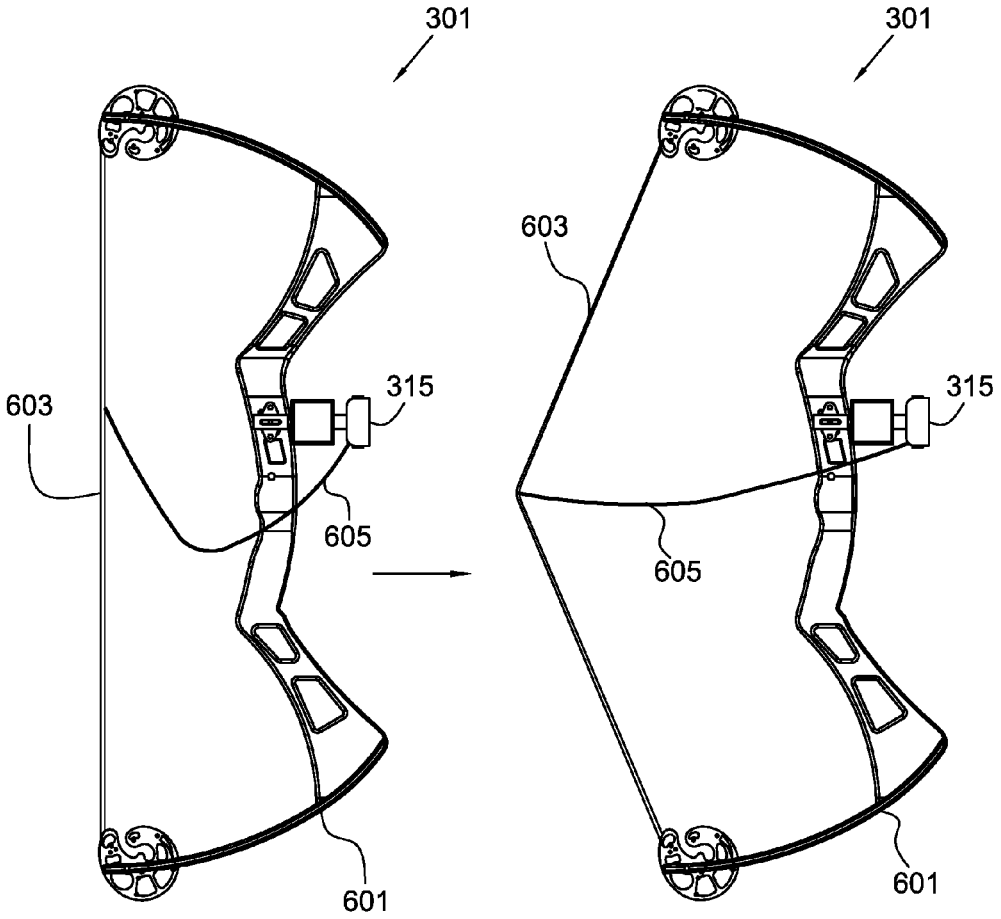
FIGS. 6A & 6B are side views of the rangefinding bow sight system of FIG. 3.

In FIGS. 6A and 6B, side views of a bow 601 with system 301 are given. An activation cord 605 is attached to the aperture sight 315 which is secured to the bow cable 603. When the shooter draws the bow cable 603 backward, the tension in the activation cord 605 enables all functionality of the system 301. FIG. 6A depicts the bow cable 603 in the balanced position showing the slack in the activation cord 605. The slack in the activation cord 605 is taken up when the bow cable is retracted as shown in FIG. 6B. This feature provides a means for the user to preserve battery life as well as limit the light emitted by the display monitor in a hunting environment. Alternatively, system 301's functionality can be manually enabled by using the display monitor.

Figure 7:
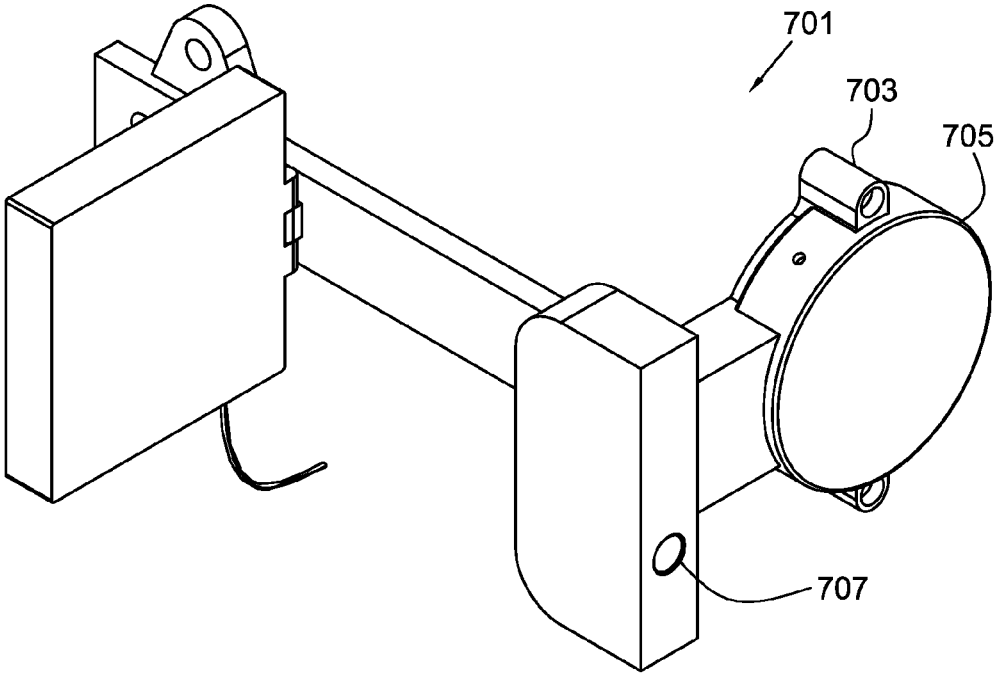
FIG. 7 is an oblique view in accordance with an alternative embodiment of the present application.
Figure 8:
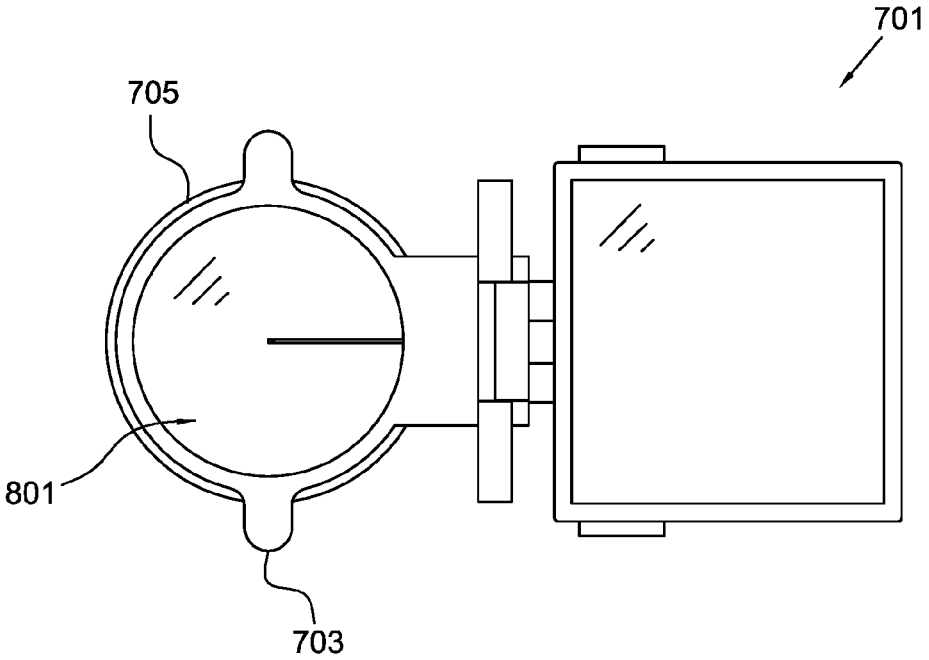
FIG. 8 is a front view of the rangefinding bow sight system of FIG. 7.

In FIGS. 7 & 8, an oblique view and front view of rangefinding bow sight system 701 are shown in accordance with an alternative embodiment of the present application, respectively. System 701 is substantially similar in function to system 301 and it is contemplated interchanging the features of the different types of the systems discussed herein.

In this embodiment, system 701 includes a sight display screen 705 which is removably attached to sight aperture 703. Additionally, system 701 includes a thermal image camera 707 which is connected to the sight display screen 705. The camera 707 sends thermal image video and pictures to the sight display screen to provide a means for the user to see objects in the dark. The thermal image video and pictures are projected on the screen surface 801 as depicted in FIG. 8. The sight display screen 705 of system 701 can be quickly removed to allow the system to operate as system 301. It will be appreciated that all features of the systems discussed herein are adapted for use with different types of bows, thus providing a universal means of attachment and should not be limited in scope and protection to the particular embodiments shown herein.

Figure 9:
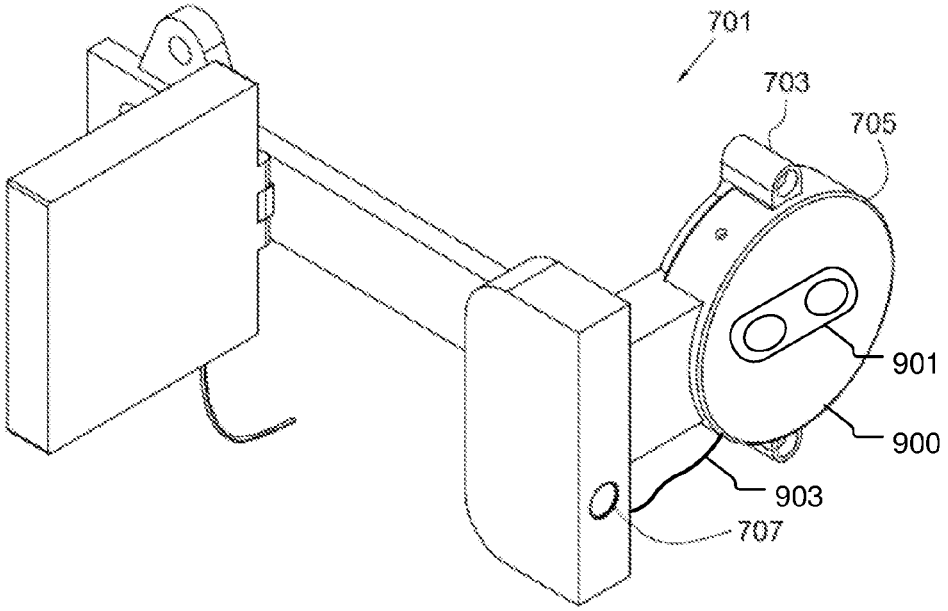
FIG. 9 is an oblique view in accordance with an alternative embodiment of the present application
Figure 10:
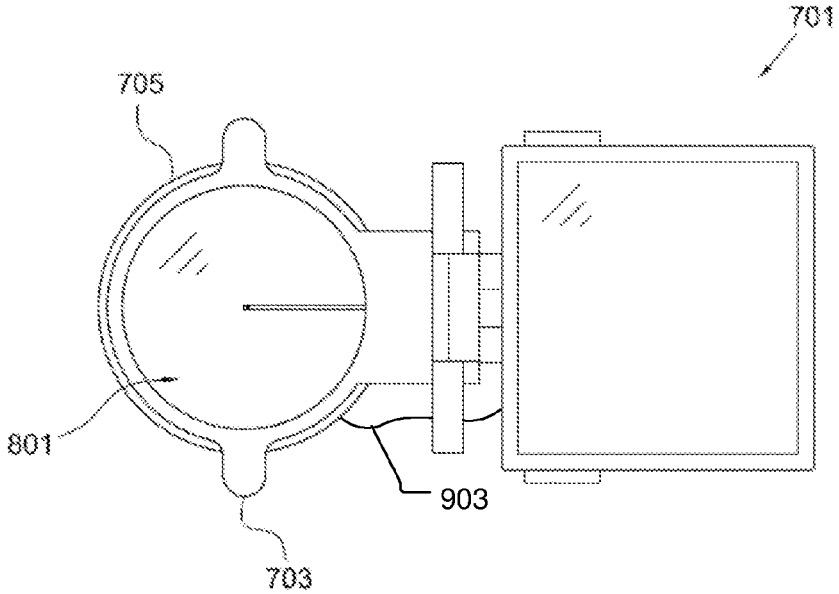
FIG. 10 is a front view of the rangefinding bow sight system of FIG. 7

Referring now to FIGS. 8 and 9 in the drawings, oblique views of the system discussed herein is further provided with one or more of a thermal imaging camera 901 secured to the cap 900 and a cord 903 secured to the camera. In one contemplated embodiment, the thermal imaging cameras are Flir Lepton thermal cameras; however, other types of thermal imagining cameras are also contemplated.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A combination of a bow and a range finder system, comprising:

the bow having a body with a draw string;

the range finder system, having:

a frame with a mounting bracket secured to one end, the mounting bracket being configured to engage with the body of the bow;

a housing secured to the frame;

a camera carried by the housing;

a display secured to the frame and conductively coupled to the camera;

a sight aperture having an opening and secured to the housing;

a cap configured to removably engage with and enclose the opening of the sight aperture;

a thermal imaging camera secured to an outer surface of the cap; and an activation cord secured to the housing and the draw string, the activation cord being configured to activate the range finder system upon draw of the draw string;

wherein the camera captures images and the images are displayed on the display.

2. The combination of claim 1, wherein the display is pivotally attached to the frame.

3. The combination of claim 1, further comprising:

a laser secured to the sight aperture.

4. The combination of claim 3, further comprising:

a sight pin extending within the opening of the sight aperture; and a fiber optic cable extending through the sight pin.

5. The combination of claim 1, further comprising:

a battery port secured to the housing and conductively coupled to a battery carried within the housing.

* * * * *